US007735976B2

(12) United States Patent
Cha et al.

(10) Patent No.: US 7,735,976 B2
(45) Date of Patent: Jun. 15, 2010

(54) INKJET PRINTHEAD USING NON-AQUEOUS INK

(75) Inventors: Tae-woon Cha, Seoul (KR); Tae-kyung Lee, Suwon-si (KR); Jae-woo Chung, Yongin-si (KR)

(73) Assignee: Samsung Electro-Mechanics Co., Ltd, Suwon-si (KR)

( * ) Notice: Subject to any disclaimer, the term of this patent is extended or adjusted under 35 U.S.C. 154(b) by 413 days.

(21) Appl. No.: 11/756,042

(22) Filed: May 31, 2007

(65) Prior Publication Data

US 2008/0158305 A1 Jul. 3, 2008

(30) Foreign Application Priority Data

Dec. 27, 2006 (KR) ..... 10-2006-0135547

(51) Int. Cl.
*B41J 2/045* (2006.01)

(52) U.S. Cl. ..... 347/68

(58) Field of Classification Search ..... 347/68, 347/69–72, 45, 21, 9; 400/124.16, 124.17; 310/363–366
See application file for complete search history.

(56) References Cited

U.S. PATENT DOCUMENTS

| | | | | |
|---|---|---|---|---|
| 5,812,158 | A * | 9/1998 | Murthy et al. | 347/45 |
| 6,416,159 | B1 * | 7/2002 | Floyd et al. | 347/21 |
| 2008/0012887 | A1 * | 1/2008 | Maeno et al. | 347/9 |
| 2008/0074473 | A1 * | 3/2008 | Takabe et al. | 347/70 |

* cited by examiner

*Primary Examiner*—K. Feggins
(74) *Attorney, Agent, or Firm*—Stanzione & Kim LLP

(57) ABSTRACT

An inkjet printhead that uses a non-aqueous ink. The inkjet printhead includes a flow channel plate having an ink channel, and a nozzle plate which is combined with the flow channel plate and has a plurality of nozzles through which the non-aqueous ink is ejected, wherein a non-wetting coating film is formed on inner walls of the ink channel and the nozzles.

12 Claims, 4 Drawing Sheets

INKJET PRINTHEAD USING NON-AQUEOUS INK

CROSS-REFERENCE TO RELATED APPLICATIONS

This application claims the benefit of Korean Patent Application No. 10-2006-0135547, filed on Dec. 27, 2006, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to an inkjet printhead that uses non-aqueous ink.

2. Description of the Related Art

An inkjet printhead is a device that prints a predetermined color image by ejecting minute droplets of ink on desired areas of a printing medium. Inkjet printheads can be generally classified into two types according to the ejection mechanism of ink droplets. The first type is a thermal inkjet printhead that ejects ink droplets using the expansion force of ink bubbles created using a heat source, and the second type is a piezoelectric inkjet printhead that ejects inkjet droplets using a pressure created by the deformation of a piezoelectric element.

FIG. 1 is a schematic cross-sectional view of a piezoelectric inkjet printhead as an example of a conventional inkjet printhead. Referring to FIG. 1, a flow channel plate 10 includes a manifold 11, a plurality of restrictors 12, and a plurality of pressure chambers 13, which constitute an ink channel. A vibration plate 20 that is deformed due to driving of piezoelectric actuators 40 is combined with an upper surface of the flow channel plate 10. A nozzle plate 30 having a plurality of nozzles 31 is combined with a lower surface of the flow channel plate 10. The flow channel plate 10 and the vibration plate 20 can be formed as one unit, and also the flow channel plate 10 and the nozzle plate 30 can be formed as one unit. The flow channel plate 10, the nozzle plate 30, and the vibration plate 20 are usually formed of silicon.

The manifold 11 is a path for supplying ink from an ink tank (not illustrated) to the pressure chambers 13, and the restrictors 12 are paths for supplying ink to the pressure chambers 13 from the manifold 11. The pressure chambers 13 are filled with ink to be ejected, and are arranged on one side or both sides of the manifold 11. The nozzles 31 are formed through the nozzle plate 30 and are connected to the pressure chambers 13. The vibration plate 20 is formed on an upper surface of the flow channel plate 10 to cover the pressure chambers 13. The vibration plate 20 is deformed due to the driving of the piezoelectric actuators 40 and provides pressure for the pressure chambers 13 to eject ink. Each of the piezoelectric actuators 40 includes a lower electrode 41, a piezoelectric film 42, and an upper electrode 43 sequentially formed on the vibration plate 20.

In an inkjet printhead having the above structure, an ink-philic coating film 34 formed of thermally oxidized silicon is formed on inner walls of the nozzles 31 and inner walls of the ink channel. The ink channel is a path for ink flow and includes the pressure chambers 13, the restrictors 12, and the manifold 11. If the inner walls of the nozzles 31 and the ink channel have an ink-philic property, a contact angle with respect to ink is reduced, and thus, capillary force increases. Therefore, the time required for refilling ink into the pressure chambers 13 is reduced and ejection frequency can be increased. An ink-phobic coating film 38 is formed on an external surface of the nozzle plate 30. The ink-phobic coating film 38 can be formed of perfluorinated silane, which is a well known material that can minimize ink-wetting by reducing surface energy of the nozzle plate 30. If the external surface of the nozzle plate 30 has an ink-phobic property, that is, a non-wetting property, the ink-wetting at the surface of the nozzle plate 30 can be prevented, and thus, straightness of ink droplets can be ensured.

Conventional inkjet printheads mainly use aqueous ink. When aqueous ink is used in an inkjet printhead having the above structure, since the inner walls of the nozzles 31 and the ink channel have an ink-philic property, that is, a high ink wetting property, ink refill can be smoothly achieved, and the performance of the inkjet printhead can be improved since air trapping on the inner walls of the ink channel is prevented.

Recently, the application of inkjet technology to various industrial fields such as display apparatuses, radio frequency identifications (RFID), or bio-chips is being actively studied. As a result, the development of non-aqueous ink besides the conventional aqueous ink is being accelerated.

However, if non-aqueous ink is used in a conventional inkjet printhead, the inner walls of the nozzles 31 and the ink channel become contaminated by ink residues, such as a dispersing agent or a pigment. That is, since the non-aqueous ink has a low surface tension compared to the conventional aqueous ink, the non-aqueous ink can relatively easily wet the inner walls of the nozzles 31 and the ink channel. Also, the non-aqueous ink has a high vapor pressure, since the non-aqueous ink easily vaporizes. Accordingly, the dispersing agent or the pigment in the non-aqueous ink strongly combines with oxidized silicon, which has a high surface energy, and as a result, the residue such as the dispersing agent or the pigment is adsorbed on the inner walls of the nozzles 31 and the ink channel. Also, since the non-aqueous ink has a high vapor pressure compared to the aqueous ink, ink evaporation actively occurs at a meniscus portion of ink that contacts the air, and as a result, the ink residue is adsorbed on the walls of the nozzles 31.

FIGS. 2 and 3 respectively are photo images of an inner wall of a nozzle and an inner wall of a restrictor, which are contaminated by residues when non-aqueous ink is used in an inkjet printhead of FIG. 1. However, a method of cleaning the inner walls of the nozzles and the ink channel when the inner walls of the nozzles and the ink channel are contaminated has not yet been developed.

SUMMARY OF THE INVENTION

The present invention provides an inkjet printhead that can prevent nozzles and ink channels from being contaminated by ink residues of non-aqueous ink.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an inkjet printhead that uses a non-aqueous ink, including a flow channel plate having an ink channel, and a nozzle plate which is combined with the flow channel plate and has a plurality of nozzles through which the non-aqueous ink is ejected, wherein a non-wetting coating film is formed on inner walls of the ink channel and the nozzles.

The non-wetting coating film may be further formed on a surface of the nozzle plate outside the nozzles.

The non-wetting coating film may have a contact angle of approximately 40 to 90° with respect to the non-aqueous ink, and may be formed of perflurinated silane.

The ink channel may be filled with the non-aqueous ink to be ejected, and may comprise a plurality of pressure chambers which are connected to the nozzles, a manifold to supply the non-aqueous ink to the pressure chambers, and a plurality of restrictors that connect the manifold to the pressure chambers.

The flow channel plate and the nozzle plate are formed of silicon, and in this case, may be formed as one unit.

The inkjet printhead may further include an ink-philic coating film formed of oxidized silicon between the flow channel plate and the non-wetting coating film and between the nozzle plate and the non-wetting coating film.

The foregoing and/or other aspects and utilities of the present general inventive concept are achieved by providing an inkjet printhead, including an ink flow path in which ink is contained and ejected our of, a nozzle plate including at least one nozzle formed therethrough to provide a path in which the ink is ejected out of the ink flow path, and a coating film providing a low surface energy formed on the inner walls of the flow path and the at least one nozzle.

The coating film can be a non-wetting coating film.

The ink flow path may include at least one pressure chamber, a manifold to supply non-aqueous ink to the at least one pressure chamber, and a restrictor corresponding to each of the at least one pressure chambers to connect the manifold to each of the at least one pressure chambers.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
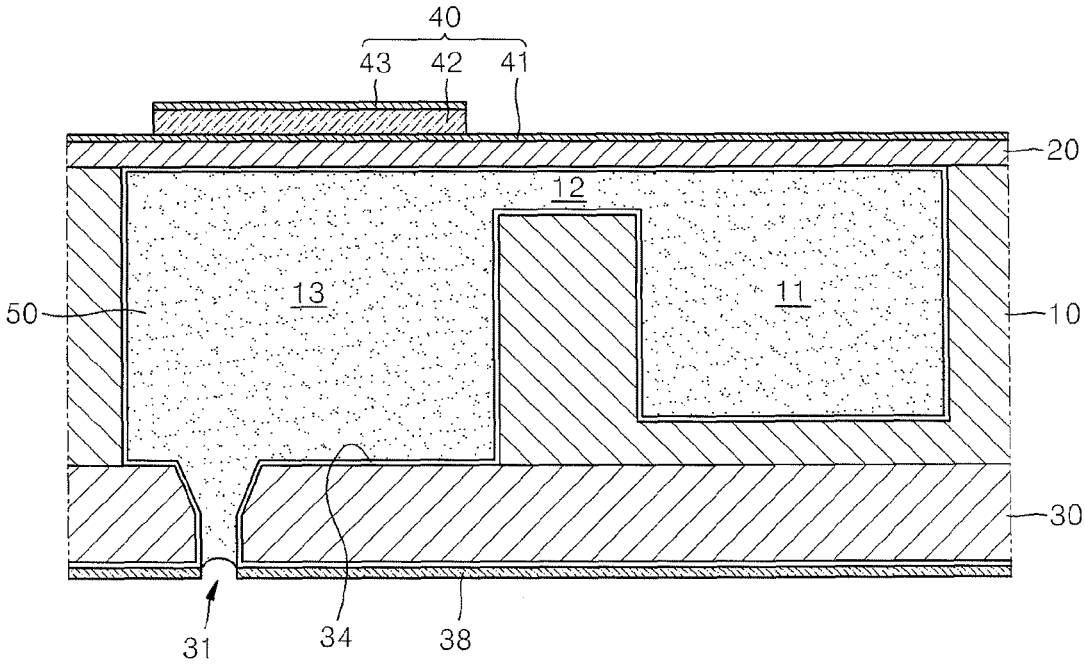
FIG. 1 (PRIOR ART)
FIG. 1 is a schematic cross-sectional view of a conventional piezoelectric inkjet printhead as an example of a conventional inkjet printhead.
Figure 2:
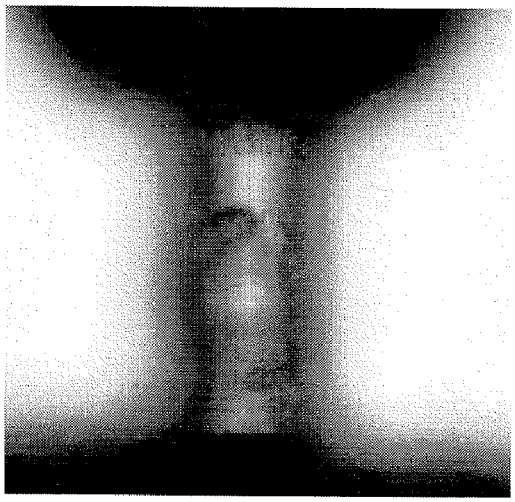
FIG. 2 is a photograph image illustrating an inner wall of a nozzle contaminated by residues of non-aqueous ink in the conventional inkjet printhead of FIG. 1.
Figure 3:
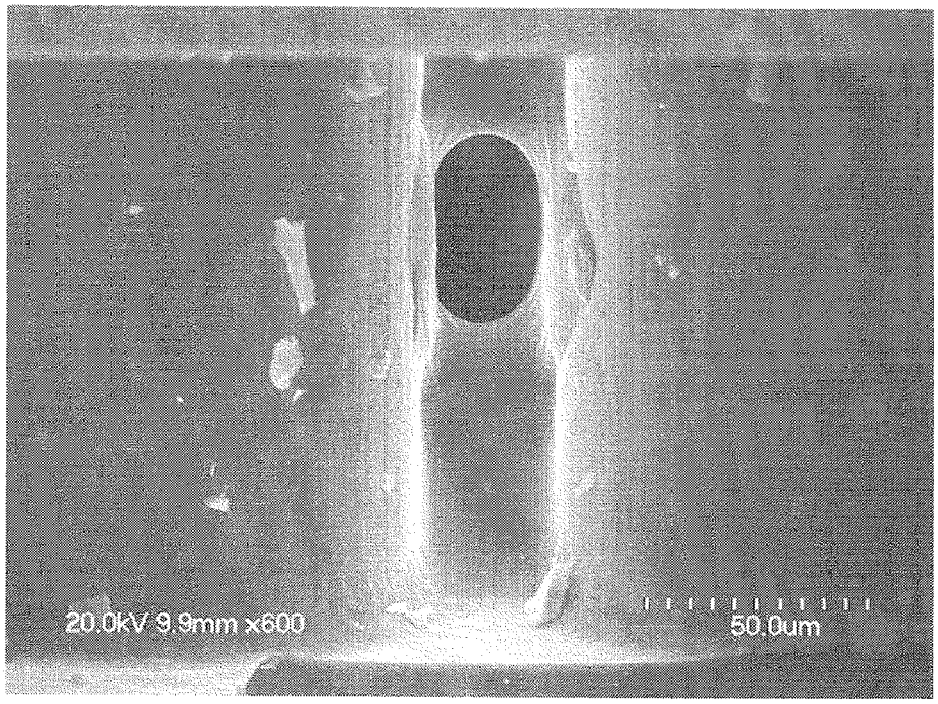
FIG. 3 is a photograph image illustrating an inner wall of a restrictor contaminated by residues of non-aqueous ink in the conventional inkjet printhead of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
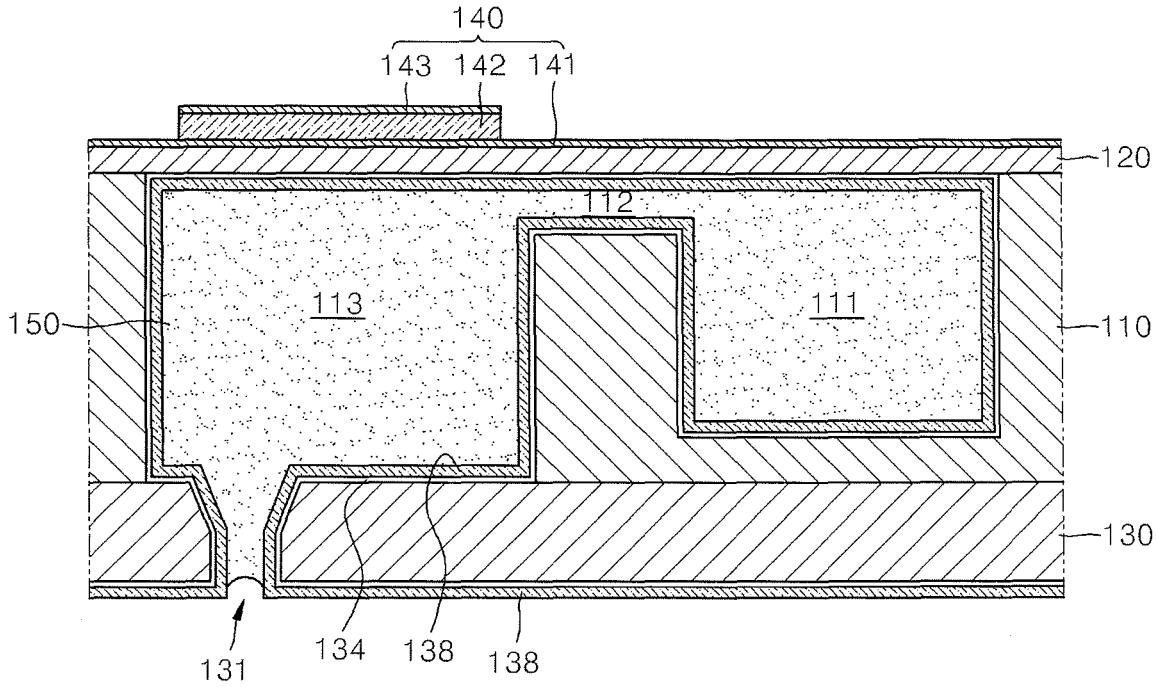
FIG. 4 is a schematic cross-sectional view of an inkjet printhead according to an embodiment of the present general inventive concept.

An inkjet printhead according to an embodiment of the present general inventive concept uses non-aqueous ink. FIG. 4 is a schematic cross-sectional view of an inkjet printhead according to an embodiment of the present invention.

Referring to FIG. 4, an inkjet printhead according to an embodiment of the present general inventive concept includes a flow channel plate 110 and a nozzle plate 130 bonded to a lower surface of the flow channel plate 110. The flow channel plate 110 includes an ink channel which is a path to flow non-aqueous ink 150. The nozzle plate 130 includes a plurality of nozzles 131. A vibration plate 120 is formed on an upper surface of the flow channel plate 110, and constitutes an upper wall of the ink channel. The vibration plate 120 is deformed by the driving of piezoelectric actuators 140 formed thereon, and thus, provides pressure to pressure chambers 113 formed under the vibration plate 120 to eject ink. Each of the piezoelectric actuators 140 includes a lower electrode 141, a piezoelectric film 142, and an upper electrode 143 sequentially formed on the vibration plate 120. The lower electrode 141 is formed on the entire surface of the vibration plate 120 and acts as a common electrode. The piezoelectric film 142 is formed on the lower electrode 141 and disposed at locations corresponding to each of the pressure chambers 113. The upper electrode 143 is formed on the piezoelectric film 142 and acts as a driving electrode that applies a voltage to the piezoelectric film 142.

The flow channel plate 110 and the nozzle plate 130 can be formed as one unit, and also, the flow channel plate 110 and the vibration plate 120 can be formed as one unit. The flow channel plate 110, the nozzle plate 130, and the vibration plate 120 may be usually formed of silicon.

The ink channel formed in the flow channel plate 110 includes a manifold 111, a plurality of restrictors 112, and the plurality of pressure chambers 113. The manifold 111 is a path to supply the non-aqueous ink 150, which enters from an ink tank (not illustrated), to the pressure chambers 113. The restrictors 112 are paths to supply the non-aqueous ink 150 to the pressure chambers 113 from the manifold 111. The pressure chambers 113 are filled with the non-aqueous ink 150 to be ejected to the outside, and are arranged on one side or both sides of the manifold 111. The plurality of nozzles 131 are formed through the nozzle plate 130, and are connected to the pressure chambers 113.

In the inkjet printhead having the above structure, an ink-philic coating film 134 is formed on all the inner walls of the ink channel, that is, on inner surfaces of the flow channel plate 110 and a lower surface of the vibration plate 120. The ink-philic coating film 134 is also formed on inner walls of the nozzles 131 and on a surface of the nozzle plate 130 outside the nozzles 131. The ink-philic coating film 134 can be formed of oxidized silicon. The ink-philic coating film 134 can be formed by thermally oxidizing the surfaces of the flow channel plate 110, the vibration plate 120, and the nozzle plate 130.

A non-wetting coating film 138 is formed on the ink-philic coating film 134. More specifically, the non-wetting coating film 138 is formed on all the inner walls of the ink channel and the inner walls of the nozzles 131 to contact the non-aqueous ink 150. The non-wetting coating film 138 is also formed on the external surface of the nozzle plate 130 outside the nozzles 131. The non-wetting coating film 138 can have a contact angle of approximately 40 to 90° with respect to the non-aqueous ink 150. The non-wetting coating film 138 can be made of perflurinated silane. The non-wetting coating film 138 can be formed by depositing perflurinated silane on the ink-philic coating film 134 using a chemical vapor deposition (CVD) method.

In an inkjet printhead that uses conventional aqueous ink, as depicted in FIG. 1, in order to improve the ejecting characteristics of aqueous ink and to prevent air trapping on the walls of the ink channel and the nozzles 31, the ink-philic coating film 34 formed of oxidized silicon is formed on the walls of the ink channel and the nozzles 31 to contact the aqueous ink. However, if the non-aqueous ink 150 is used in the conventional inkjet printhead, the inner walls of the ink channel and the nozzles 131, on which the ink-philic coating film 134 is coated, can be contaminated by ink residues. That is, the non-aqueous ink 150 has a surface tension lower than that of aqueous ink, and thus, is easily wetted. Also, the non-aqueous ink 150 has a high vapor pressure since the non-aqueous ink 150 easily vaporizes. Accordingly, the dispersing agent or the pigment in the non-aqueous ink strongly combines with oxidized silicon, which has a high surface energy, and as a result, a residue such as the dispersing agent or the pigment is adsorbed on the inner walls of the nozzles 31 and the ink channel. Thus, the inner walls of the nozzles 31 and the ink channel are contaminated.

To address the above and other problems, in the inkjet printhead according to an embodiment of the present general inventive concept, the non-wetting coating film 138 is coated on the inner walls of the ink channel and the nozzles 131. That is, if the non-wetting coating film 138 is formed on the inner walls of the ink channel and the nozzles 131 to contact the non-aqueous ink 150, the inner walls of the ink channel and the nozzles 131 have a low surface energy. Therefore, a residue such as a dispersing agent or a pigment contained in the non-aqueous ink 150 cannot be adsorbed on the inner walls of the ink channel and the nozzles 131.

In order to prove this fact, a zeta potential of oxidized silicon was measured when the oxidized silicon contacted air and the non-aqueous ink, respectively. The result shows that the zeta potential of the oxidized silicon that contacts the non-aqueous ink is approximately 5 times greater than that of the oxidized silicon that contacts the air. This proves that when the oxidized silicon contacts the non-aqueous ink, charged particles of a dispersing agent or a pigment included in the non-aqueous ink strongly combine with oxidized silicon. Next, the zeta potential of the non-wetting coating film 138 formed of perflurinated silane was measured when the non-wetting coating film 138 contacted air and the non-aqueous ink, respectively. The result shows that the zeta potential of the non-wetting coating film 138 that contacted the non-aqueous ink 150 was similar to that of the non-wetting coating film 138 that contacted the air. This proves that the charged particles included in the non-aqueous ink 150 do not react with perflurinated silane. From this result, if the non-wetting coating film 138 is formed on the inner walls of the ink channel and the nozzles 131 as in the inkjet printhead according to an embodiment of the present general inventive concept, the reside included in the non-aqueous ink 150 is not adsorbed on the inner walls of the ink channel and the nozzles 131.

Figure 5:
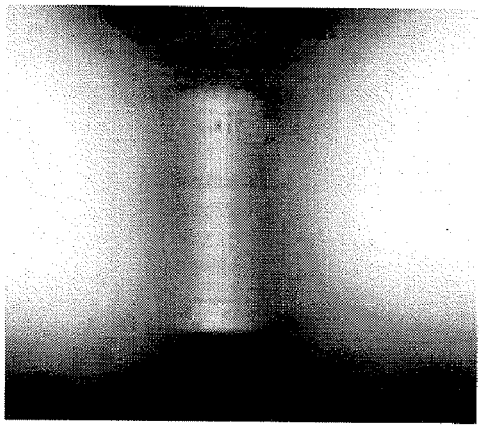
FIG. 5 is a photograph image illustrating an inner wall of a nozzle of the inkjet printhead of FIG. 4, according to an embodiment of the present general inventive concept.
Figure 6:
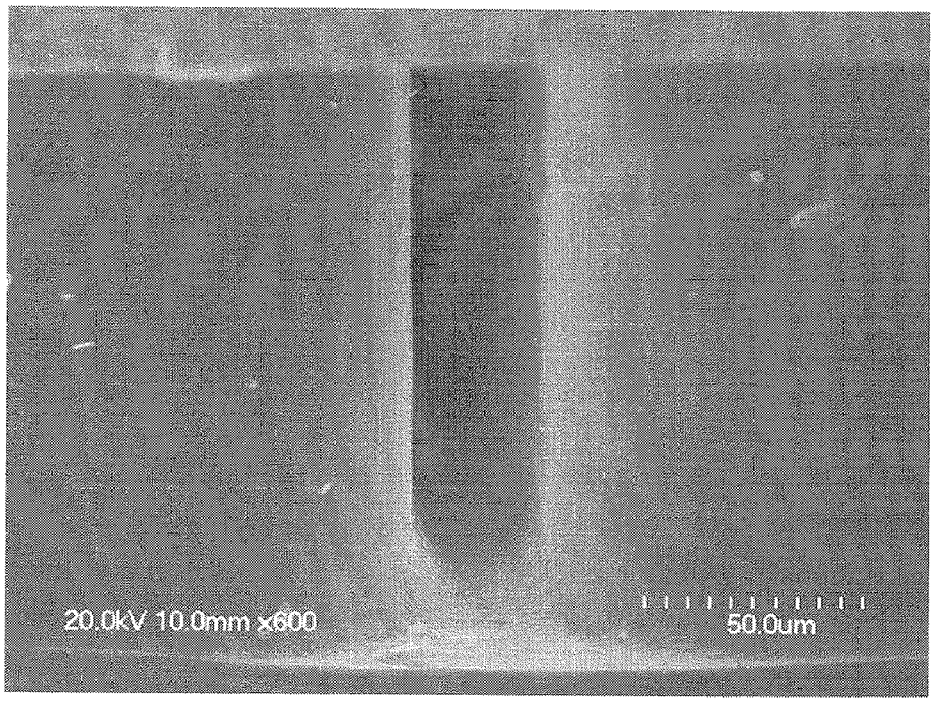
FIG. 6 is a photograph image illustrating an inner wall of a restrictor of the inkjet printhead of FIG. 4, according to an embodiment of the present general inventive concept.

FIG. 5 is a photograph image illustrating an inner wall of a nozzle of the inkjet printhead, and FIG. 6 is a photograph image illustrating an inner wall of a restrictor of the inkjet printhead of FIG. 4, according to an embodiment of the present general inventive concept. Referring to FIGS. 5 and 6, in the inkjet printhead according to an embodiment of the present general inventive concept, the inner walls of the nozzles 131 and the restrictors 112 are not contaminated by the ink residue.

The inner walls of the ink channel and the nozzles 131 have a contact angle of approximately 40 to 90° with respect to the non-aqueous ink 150, and thus, an air trapping problem does not occur. In order to prove this fact, one billion jetting operations were performed with respect to an inkjet printhead in which the non-wetting coating film 138 was formed on the inner walls of the ink channel and the nozzles 131 using the non-aqueous ink 150, and afterwards, the ejection characteristics were investigated. The result shows that unstable ejection due to the air trapping is not observed. Also, improper ejection due to the contamination of the inner walls of the ink channel and the nozzles 131 with ink residue is not observed.

In the inkjet printhead according to an embodiment of the present general inventive concept, the non-wetting coating film 138 is formed on the outer surface of the nozzle plate 130 outside the nozzles 131. If the external surface of the nozzle plate 130 has a non-wetting property, that is, an ink-phobic property, ink wetting on the external surface of the nozzle plate 130 is prevented, and thus, the straightness of ink droplets ejected to the outside is ensured.

In the present embodiment, an inkjet printhead in which the ink-philic coating film 134 is formed on the inner walls of the ink channel and the nozzles 131 and on an external surface of the nozzle plate 130, and in which the non-wetting coating film 138 is formed on the ink-philic coating film 134 has been described. However, the present general inventive concept is not limited thereto. That is, the ink-philic coating film 134 may not be formed. That is, the non-wetting coating film 138 can be formed by directly depositing perflurinated silane on the inner walls of the ink channel and the nozzles 131 and the external surface of the nozzle plate 130.

As described above, in an inkjet printhead that uses non-aqueous ink according to the present general inventive concept, since a non-wetting coating film is formed on inner walls of an ink channel and nozzles, the ink channel and the nozzles can be prevented from being contaminated by an ink residue included in a non-aqueous ink, and as a result, the ejection characteristics and reliability of the inkjet printhead can be increased.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead that uses a non-aqueous ink, comprising:

a flow channel plate having an ink channel; and a nozzle plate combined with the flow channel plate and having a plurality of nozzles through which the non-aqueous ink is ejected, wherein a non-wetting coating film is formed on inner walls of the ink channel and the nozzles.

2. The inkjet printhead of claim 1, wherein the non-wetting coating film is further formed on a surface of the nozzle plate outside the nozzles.

3. The inkjet printhead of claim 1, wherein the non-wetting coating film has a contact angle of approximately 40 to 90° with respect to the non-aqueous ink.

4. The inkjet printhead of claim 1, wherein the non-wetting coating film is formed of perflurinated silane.

5. The inkjet printhead of claim 1, wherein the ink channel is filled with the non-aqueous ink to be ejected, and further comprises:

a plurality of pressure chambers which are connected to the nozzles;

a manifold to supply the non-aqueous ink to the pressure chambers; and a plurality of restrictors that connect the manifold to the pressure chambers.

6. The inkjet printhead of claim 1, wherein the flow channel plate and the nozzle plate are formed of silicon.

7. The inkjet printhead of claim 6, wherein the flow channel plate and the nozzle plate are formed as one unit.

8. The inkjet printhead of claim 6, further comprising:

an ink-philic coating film formed of oxidized silicon between the flow channel plate and the non-wetting coating film and between the nozzle plate and the non-wetting coating film.

9. An inkjet printhead, comprising:

an ink flow path in which non-aqueous ink is contained and ejected out of;

a nozzle plate including at least one nozzle formed therethrough to provide a path in which the non-aqueous ink is ejected out of the ink flow path; and a coating film providing a low surface energy formed on the inner walls of the flow path and the at least one nozzle.

10. The inkjet printhead of claim 9, wherein the coating film is a non-wetting coating film.

11. The inkjet printhead of claim 9, wherein the ink flow path comprises:

at least one pressure chamber;

a manifold to supply non-aqueous ink to the at least one pressure chamber; and a restrictor corresponding to each of the at least one pressure chambers to connect the manifold to each of the at least one pressure chambers.

12. An inkjet printhead, comprising:

a flow channel plate having at least one pressure chamber formed with first inner walls; and a nozzle plate disposed on the flow channel plate having at least one nozzle corresponding to the at least one pressure chamber formed with second inner walls and a first outer wall, wherein the first inner walls, the second inner walls, and the first outer wall are coated with a low surface energy film to protect the pressure chamber and the at least one nozzle from non-aqueous ink residue.

* * * * *